US011284195B2

(12) United States Patent
Johnson et al.

(10) Patent No.: US 11,284,195 B2
(45) Date of Patent: Mar. 22, 2022

(54) SYSTEM TO MOVE SOUND INTO AND OUT OF A LISTENER'S HEAD USING A VIRTUAL ACOUSTIC SYSTEM

(71) Applicant: Apple Inc., Cupertino, CA (US)

(72) Inventors: Martin E. Johnson, Los Gatos, CA (US); Afrooz Family, Los Angeles, CA (US); Darius A. Satongar, Santa Clara, CA (US); Jonathan D. Sheaffer, San Jose, CA (US); Lance F. Reichert, Oakland, CA (US); Peter V. Jupin, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/107,613

(22) Filed: Nov. 30, 2020

(65) Prior Publication Data

US 2021/0084414 A1 Mar. 18, 2021

Related U.S. Application Data

(62) Division of application No. 16/113,399, filed on Aug. 27, 2018, now Pat. No. 10,880,649.

(60) Provisional application No. 62/566,087, filed on Sep. 29, 2017.

(51) Int. Cl.

| | |
|---|---|
| ***H04R 5/033*** | (2006.01) |
| ***H04R 5/04*** | (2006.01) |
| *H04S 7/00* | (2006.01) |

(52) U.S. Cl.

CPC ..... *H04R 5/04* (2013.01); *H04R 5/033* (2013.01); *H04R 2420/01* (2013.01); *H04S 7/30* (2013.01); *H04S 2400/11* (2013.01); *H04S 2420/01* (2013.01)

(58) Field of Classification Search

CPC ..... H04R 5/04; H04R 5/033; H04R 2420/01; H04S 7/30; H04S 2420/01; H04S 2400/11

See application file for complete search history.

(56) References Cited

U.S. PATENT DOCUMENTS

| | | | | |
|---|---|---|---|---|
| 2015/0003649 | A1* | 1/2015 | Horbach | H04R 3/04 381/309 |
| 2016/0119737 | A1* | 4/2016 | Mehnert | H04S 7/303 381/310 |
| 2017/0359467 | A1* | 12/2017 | Norris | H04S 7/304 |

* cited by examiner

*Primary Examiner* — Ping Lee

(74) *Attorney, Agent, or Firm* — Womble Bond Dickinson (US) LLP

(57) ABSTRACT

In a device or method for rendering a sound program for headphones, a location is received for placing the sound program with respect to first and second ear pieces. If the location is between the first ear piece and the second ear piece, the sound program is filtered to produce low-frequency and high-frequency portions. The high-frequency portion is panned according to the location to produce first and second high-frequency signals. The low-frequency portion and the first high-frequency signal are combined to produce a first headphone driver signal to drive the first ear piece. A second headphone driver signal is similarly produced. The sound program may be a stereo sound program. The device or method may also provide for a location that is between the first ear piece and a near-field boundary. Other aspects are also described.

20 Claims, 6 Drawing Sheets

SYSTEM TO MOVE SOUND INTO AND OUT OF A LISTENER'S HEAD USING A VIRTUAL ACOUSTIC SYSTEM

This application is a divisional of pending U.S. application Ser. No. 16/113,399 filed Aug. 27, 2018, which claims the benefit of the earlier filing date of U.S. provisional application No. 62/566,087 filed Sep. 29, 2017.

FIELD

The present disclosure generally relates to the field of binaural sound synthesis; and more specifically, to binaural sound synthesis for sound that is closer to the listener than the near-field boundary.

BACKGROUND

The human auditory system modifies incoming sounds by filtering them depending on the location of the sound relative to the listener. The modified sound involves a set of spatial cues used by the brain to detect the position of a sound. Human hearing is binaural, using two ears to perceive two sound-pressure signals created by a sound.

Sound is transmitted in air by fluctuations in air pressure created by the sound source. The fluctuations in air pressure propagate from the sound source to the ears of a listener as pressure waves. The sound pressure waves interact with the environment of the path between the sound source and the ears of the listener. In particular, the sound pressure waves interact with the head and the ear structure of the listener. These interactions modify the amplitude and the phase spectrum of a sound dependent on the frequency of the sound and the direction and the distance of the sound source.

These modifications can be described as a Head Related Transfer Function (HRTF) and a Head-Related Impulse Response (HRIR) for each ear. The HRTF is a frequency response function of the ear. It describes how an acoustic signal is filtered by the reflection properties of the head, shoulders and most notably the pinna before the sound reaches the ear. The HRIR is a time response function of the ear. It describes how an acoustic signal is delayed and attenuated in reaching the ear, by the distance to the sound source and the shadowing of the sound source by the listener's head.

A virtual acoustic system is an audio system (e.g., a digital audio signal processor that renders a sound program into speaker driver signals that are to drive a number of speakers) that gives a listener the illusion that a sound is emanating from somewhere in space when in fact the sound is emanating from loudspeakers placed elsewhere. One common form of a virtual acoustic system is one that uses a combination of headphones (e.g., earbuds) and binaural digital filters to recreate the sound as it would have arrived at the ears if there were a real source placed somewhere in space. In another example of a virtual acoustic system, crosstalk cancelled loudspeakers (or cross talk cancelled loudspeaker driver signals) are used to deliver a distinct sound-pressure signal to each ear of the listener.

Binaural synthesis transforms a sound source that does not include audible information about position of the sound source to a binaural virtual sound source that includes audible information about a position of the sound source relative to the listener. Binaural synthesis may use binaural filters to transform the sound source to the binaural virtual sound sources for each ear. The binaural filters are responsive to the distance and direction from the listener to the sound source.

Sound pressure levels for sound sources that are relatively far from the listener will decrease at about the same rate in both ears as the distances from the listener increases. The sound pressure level at these distances decreases according to the spherical wave attenuation for the distance from the listener. Sound sources at distances where sound pressure levels can be determined based on spherical wave attenuation can be described as far-field sound sources. The far-field distance is the distance at which sound sources begin to behave as far-field sound sources. The far-field distance is greatest for sounds that lie on an axis that passes through the listener's ears and smallest on a perpendicular axis that passes through the midpoint between the listener's ears. The far-field distance on the axis that passes through the listener's ears may be about 1.5 meters. The far-field distance on the perpendicular axis that passes through the midpoint between the listener's ears may be about 0.4 meters. Sound sources at the far-field distance or greater from the listener can be modeled as far-field sound sources.

As a sound source approaches the listener, the effects of the interaction between the listener's head and body and the sound pressure waves become increasingly prominent. The difference in sound intensity between the listener's ears is called the Interaural Level Difference (ILD). A sound that is moving toward the listener along the axis that passes through the listener's ears will increase in intensity at the ipsilateral ear and simultaneously decrease in intensity at the contralateral ear because of head shadowing effects. The ILD starts to increase at a distance of about 0.5 meters and becomes pronounced at a distance of about 0.25 meters.

The difference in sound arrival time between the listener's ears is called the Interaural Time Difference (ITD). The ITD also increases rapidly as a sound source moves toward the listener, and the difference in distances from the sound source to the listener's two ears becomes more pronounced. Sound sources at distances where the effects of the listener's head and body become prominent can be described as near-field sound sources. Sound sources that are less than about 1.0 to 1.5 meters from the listener need to be modeled (to simulate how a listener would hear them) with binaural filters that include these near-field effects.

Modeling of sound sources with binaural filters that include near-field effects can be effective for distances of about 0.25 meters or more. As the desired location for the sound source gets very close to the listener, e.g. less than about 0.25 meters, binaural filters that include near-field effects begin to produce binaural audio signals that have been found to be subjectively undesirable. Head shadowing effects may become so prominent that the sound becomes inaudible at the contralateral ear, producing an uncomfortable feeling of occlusion in the contralateral ear.

SUMMARY

If it is desired to reduce the distance to a perceived sound source so as to place the sound at a location between the listener's ears (also referred to as an in-head location), binaural filters that are based on HRTFs are no longer applicable. That is because HRTFs are derived from microphone measurements that detect the sound arriving from sound sources that are placed at a distance from a listener's head, where the detected sound has of course been altered by the listener's head and shoulders. The measurements for deriving HRTFs may be made using microphones located at a listener's ears or in the ears of a dummy head or acoustic manikin.

It would be desirable to provide a way to synthesize binaural audio signals (that would drive respective earphone transducers at the left and right ears of a listener) for a virtual acoustic system, to create the illusion of a sound source moving toward or away from the listener between i) the end of the effective range of near-field modeling and the center of the listener's head or another in-head location.

In a device or method for rendering a sound program for headphones, a location is received for placing the sound program with respect to first and second ear pieces. If the location is between the first ear piece and the second ear piece (an in-head location), then the sound program is filtered to produce low-frequency and high-frequency portions. The high-frequency portion is panned according to the location to produce first and second high-frequency signals. The low-frequency portion and the first high-frequency signal are combined to produce a first headphone driver signal to drive the first earpiece. A second headphone driver signal is similarly produced, by combining the low-frequency portion and the second high-frequency signal to produce a second in-head signal. The sound program may be a stereo sound program. The device or method may provide for rendering of the sound program at a location between the first ear piece and a near-field boundary. The location may be variable over time, so that the method can for example move the sound program gradually from an in-head position to an outside-the-head position, or vice-versa (e.g., from outside-the-head to an in-head position.)

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

In the following description, numerous specific details are set forth.

However, it is understood that the disclosed aspects may be practiced without these specific details. In other instances, well-known circuits, structures and techniques have not been shown in detail in order not to obscure the understanding of this description.

In the following description, reference is made to the accompanying drawings, which illustrate several aspects of the present disclosure. It is understood that other aspects may be utilized, and mechanical compositional, structural, electrical, and operational changes may be made without departing from the spirit and scope of the present disclosure. The following detailed description is not to be taken in a limiting sense, and the scope of the invention is defined only by the claims of the issued patent.

The terminology used herein is for the purpose of describing particular aspects only and is not intended to be limiting of the present disclosure. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
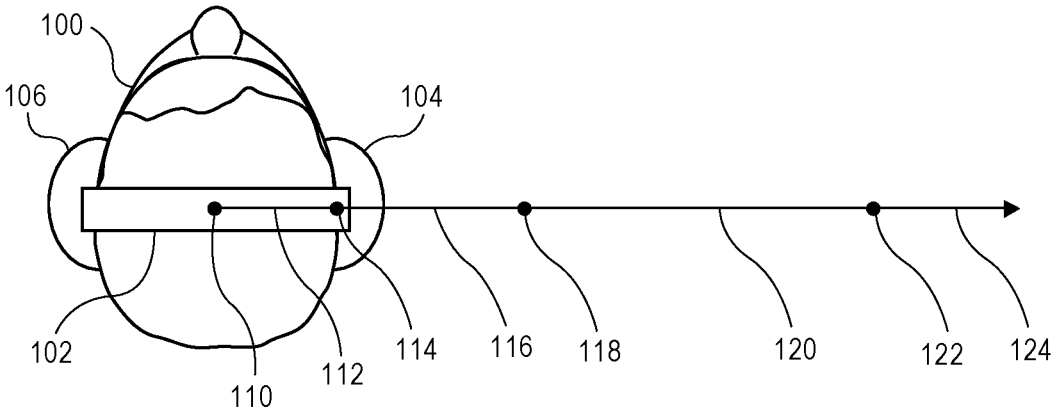
FIG. 1 is a view of an illustrative listener wearing headphones.

FIG. 1 is a plan view of an illustrative listener 100 wearing headphones 102 having a first ear piece 104 and a second ear piece 106 to present a distinct sound-pressure signal to each ear of the listener. While headphones having a headband that is joined to the ear pieces are shown in FIG. 1, it should be appreciated that wired or wireless ear buds may similarly be used. For the purposes of the present disclosure, the term "headphones" is intended to encompass on-ear headphones, over-the-ear headphones, earbuds that rest outside the ear canal, in-ear headphones that are inserted into the ear canal, and other audio output devices that deliver a distinct sound program to each ear of the listener with no significant cross-over of each ear's sound program to the other ear of the listener.

FIG. 1 shows a vector having an origin at the midpoint 110 between the two ear pieces 104, 106, which is generally the center of the user's head. The vector extends through the first ear piece 104, shown as the ear piece for the right ear of the listener 100. The vector may be divided into regions by i) a boundary 114 at the ear piece 104, a boundary 118 where a near-field HRTF becomes effective, and a boundary 122 where a far field HRTF becomes effective. A virtual acoustic system according to the present disclosure may select the processing for a sound signal according to a desired placement of the sound signal in one of the regions between these boundaries. It will be appreciated that a similar vector can be extended through the second ear piece 106, shown as the ear piece for the left ear of the listener 100, to provide corresponding regions on the opposite side of the listener. While the boundaries are illustrated as points on a vector, it will be appreciated that the boundaries extend as three-dimensional surfaces around the listener. The distance from the center of the user's head to a boundary may depend on the angle to the boundary. Therefore the boundary surfaces will generally not be spherical. Aspects of the disclosure are described with reference to the vector for clarity. But these aspects may also be used for sounds located anywhere in three-dimensional space.

The regions created by the above boundaries may be described as an in-head region 112, a transition region 116, a near-field region 120, and a far-field region 124. The in-head region 112 is the region between the two ear pieces 104, 106. The in-head region 112 may be considered as two symmetric regions that extend from the center 110 of the user's head to one of the two ear pieces 104, 106. The transition region 116 is the region (outside the listeners head) between one of the two earpieces 104, 106 and the adjacent near-field boundary 118. The near-field region 120 is the region between the near-field boundary 118 and the far-field boundary 122. The far-field region 124 extends away from the listener 100 from the far-field boundary 122. Aspects of the present disclosure produce headphone driver signals to drive the two ear pieces 104, 106 that allow a sound program to be placed in these various regions.

Figure 2:
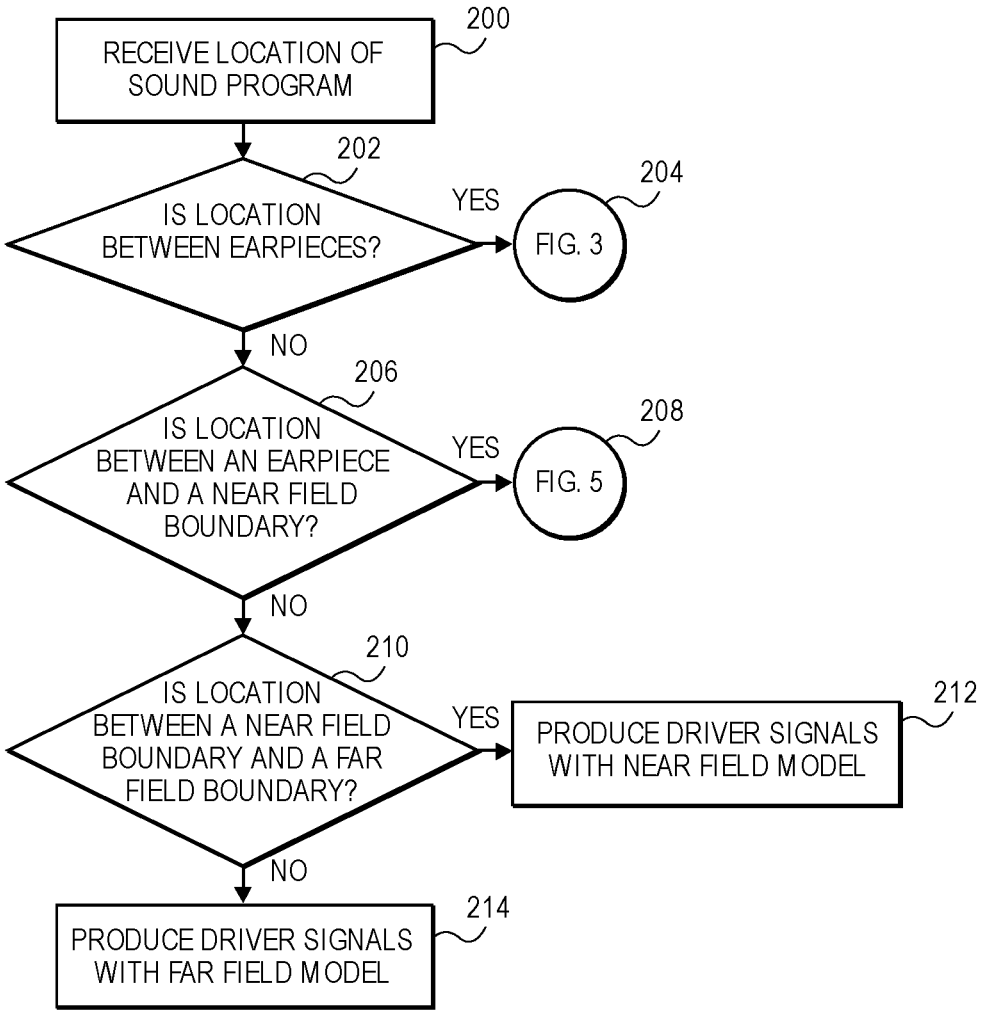
FIG. 2 is a flowchart of a portion of a process for synthesizing a binaural program according to distance of the sound from the listener.

FIG. 2 is a flow chart for a method of processing a sound program according to a determined rendering mode. The operations of the method may be performed by a programmed digital processor operating, operating upon a digital sound program (e.g., including a digital audio signal). A location of the sound program is received (operation 200) by a sound location classifier. If the sound location is in the in-head region 112 between the two ear pieces (operation 202), processing is done according to a first rendering mode as in the flowchart shown in FIG. 3 (operation 204.) If the sound location is in the transition region 116 between one of the two ear pieces and the adjacent near-field boundary (operation 206), processing is done according to a second rendering mode as in the flowchart shown in FIG. 5 (operation 208). If the sound location is in the near-field region 120 between the near-field boundary and the far-field boundary (operation 210), processing is done according to a third rendering mode, using a near-field model 212. Otherwise, processing is done according to a fourth rendering mode a far-field model (operation 214).

Figure 3:
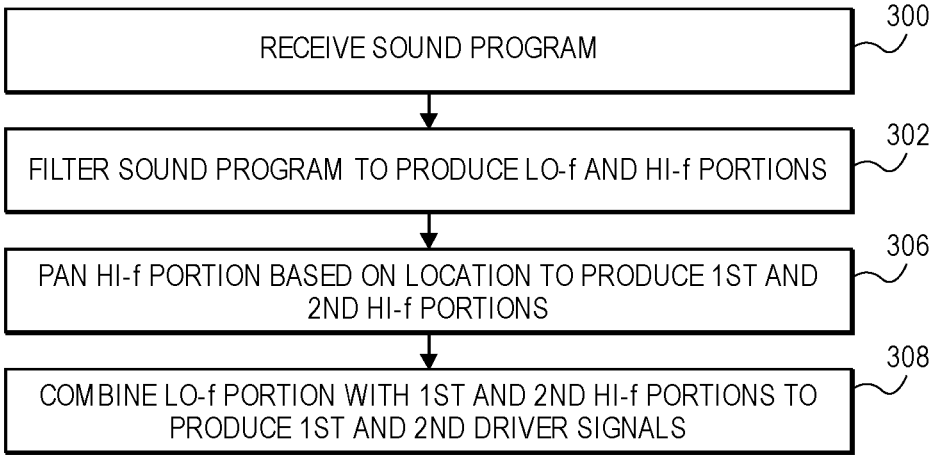
FIG. 3 is a flowchart of a portion of a process for synthesizing a binaural program for a sound located in the in-head region between the ear pieces on the listener's ears.
Figure 4:
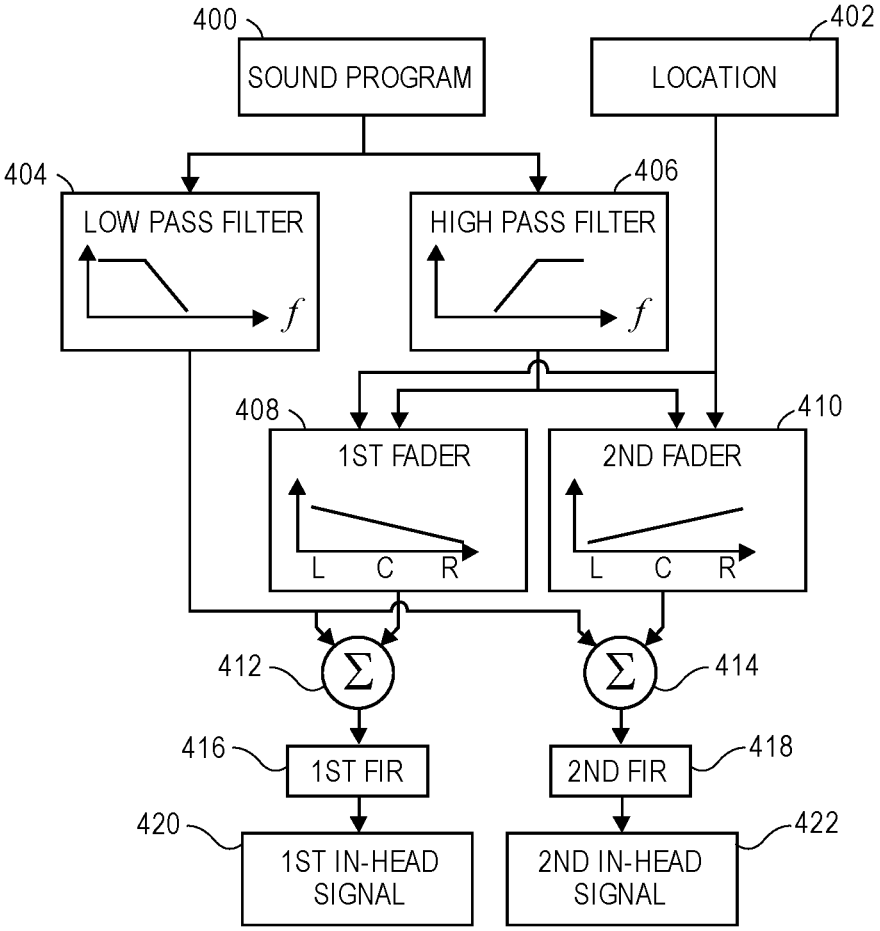
FIG. 4 is a block diagram for a portion of a circuit for processing the sound program when the sound location is in the in-head region between the two ear pieces.

FIG. 3 is a flow chart for a method of processing a sound program when the sound location is in the in-head region 112 between the two ear pieces (operation 202) according to an aspect of the present disclosure. FIG. 4 is an aspect of a portion of a circuit for processing the sound program when the sound location is in the in-head region between the two ear pieces 202.

The sound program is received (operation 300) by an audio receiver circuit 400. The desired sound location is received by a location receiver circuit 402. The audio receiver circuit 400 and the location receiver circuit 402 may be parts of a general receiver circuit. The location receiver circuit 402 may determine desired sound locations in addition to or as an alternative to receiving sound locations provided with the sound program. In one aspect, the location receiver circuit 402 may interpolate sound locations between received sound locations to provide a smoother sense of movement of the sound. In another aspect, the location receiver circuit 402 may infer the sound locations from the sound program.

The sound program is filtered to produce a low-frequency portion and a high-frequency portion (operation 302). A low pass filter 404 and a complementary high pass filter 406 may be used to produce the low-frequency and high-frequency portions of the sound program. Complementary is used herein to mean that the two filters operate with attenuations of the filtered frequencies such that combining the filtered portions will produce a signal that is audibly similar to the unfiltered sound program.

The high-frequency portion is panned according to the location to produce a first high-frequency panned portion and a second high-frequency panned portion (operation 306). The high-frequency portion may be panned by a first fader 408 and a complementary second fader 410 to produce the first and second high-frequency panned portions. Complementary is used herein to mean that the two faders operate with attenuations of the high-frequency portion such that the sound that would be created in the first ear piece 104 and the second ear piece 106 of the headphones 102 by the first and second high-frequency panned portions would create an audible impression of the high-frequency portion moving between the ear pieces (from left earpiece, or L without attenuation. This capability of the first fader 408 to adjust its gain smoothly from high to medium to low, in response to the location changing from the left earpiece (L) through the center (C) and then at the right earpiece (R), is illustrated by the downward sloped line shown in its box. Similarly, the capability of the second fader 410 to adjust its gain smoothly from low to medium to high, as the location changes from the left earpiece (L) through the center (C) and then at the right earpiece (R), is illustrated by the upward sloped line shown in its box. In some aspects, the high-frequency portion may be attenuated to an inaudible level when the location of the sound is at the opposite ear piece; in other aspects, the high-frequency portion may be attenuated to a low but audible level when the location of the sound is at the opposite ear piece.

The first and second high-frequency panned portions are each combined with the low-frequency portion to produce first and second in-head signals (operation 308). The in-head signals drive the ear pieces 104, 106 of the headphones 102. The low-frequency and high-frequency panned portions may be combined by audio mixers 412, 414. A first audio mixer 412 receives the low-frequency portion from the low pass filter 404 and the first high-frequency panned portion from the first fader 408 and combines the two audio signals to produce the first in-head signal 420 to drive the first ear piece 104. A second audio mixer 414 receives the low-frequency portion from the low pass filter 404 and the second high-frequency panned portion from the second fader 410 and combines the two audio signals to produce the second in-head signal 422 to drive the second ear piece 106.

The effect of a room impulse response may also be added to improve the quality of the virtual acoustic simulation. In this case, a first finite impulse response filter (FIR) 416 that has been configured according to a desired room impulse response may be applied to the combination of the low-frequency portion and the first high-frequency panned signal, to produce the first in-head signal 420 (as a first headphone driver signal.) A second finite impulse response filter 418 that has been configured according to a desired impulse response may be applied to the combination of the low-frequency portion and the second high-frequency panned signal, to produce the second in-head signal 422 (as a second headphone driver signal.) It will be understood that the effect of room impulse responses may be similarly added to other circuits described below, which are shown without FIR filters for clarity. In other aspects, the effect of room impulse responses may be added at other places in the circuit for example as part of binaural filters (describe further below) to better model the interaction between the listener and the virtual acoustic environment. In some aspects, the room impulse responses may change with rotations of the listener's head.

Processing the sound program as described above, when the sound is located in the in-head region between the two ear pieces (operation 202), provides an audio output for the two earpieces in which the low frequency portion of the sound program is unchanged by the location of the sound while the high frequency portion is panned between the two ear pieces according to the location of the sound. It has been found that this produces a more pleasant aural experience because the constant low frequency portion prevents the feeling of occlusion of the "distant" ear when the location of the sound is close to one ear.

Figure 5:
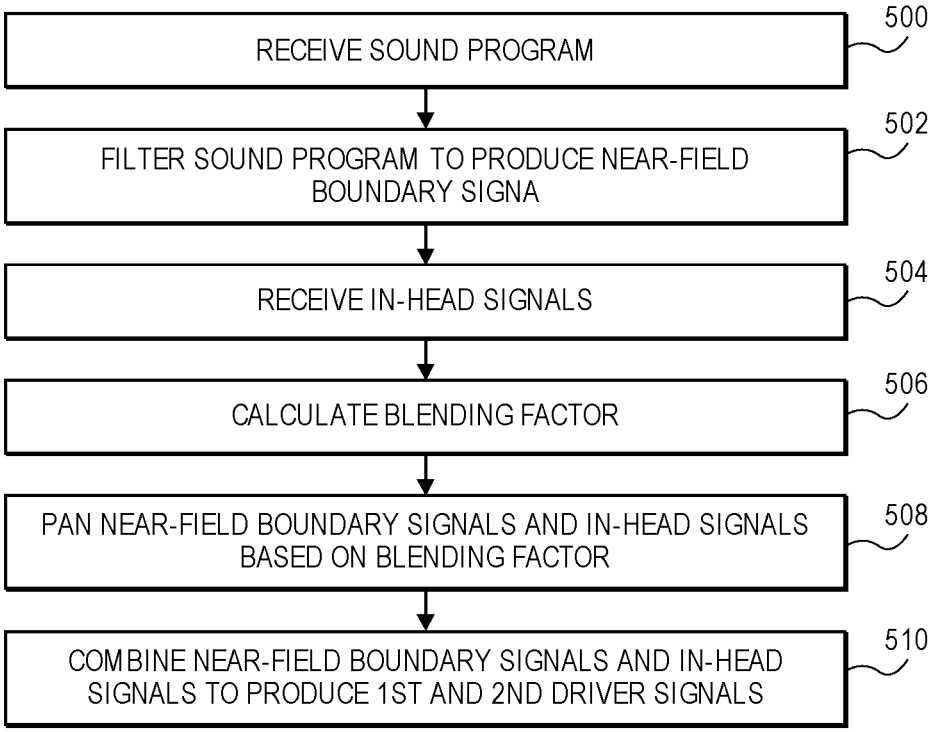
FIG. 5 is a flowchart of a portion of a process for synthesizing a binaural program for a sound located in the transition region between one of the two ear pieces and the adjacent near-field boundary.
Figure 6:
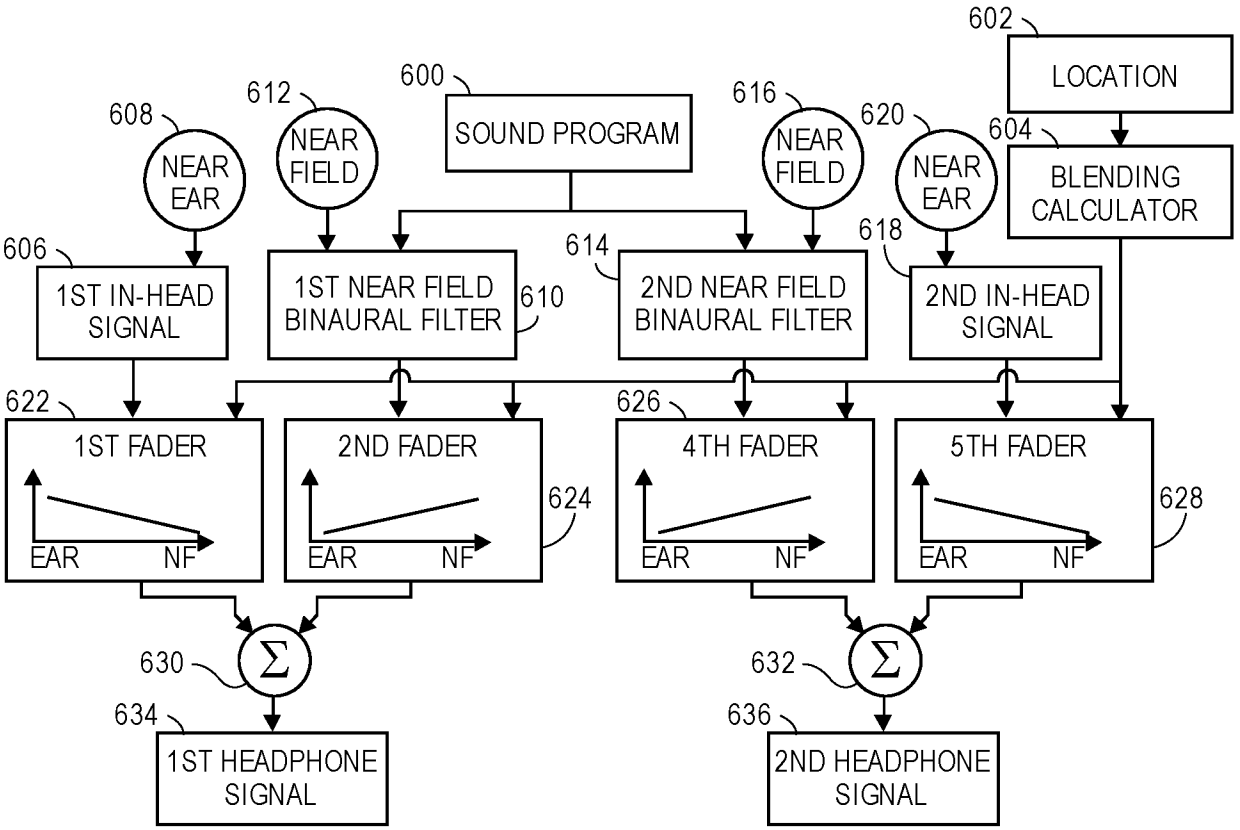
FIG. 6 is a block diagram for a portion of a circuit for processing the sound program when the sound location is in the transition region between one of the two ear pieces and the adjacent near-field boundary.

FIG. 5 is a flow chart for a method of processing a sound program when the sound location is in the transition region 116, between one of the two ear pieces 104, 106 and the adjacent near-field boundary 118, according to an aspect of the present disclosure. FIG. 6 is a portion of a circuit for processing the sound program when the sound location is in the transition region 116. The sound program is received (operation 500) by an audio receiver circuit 600. The desired sound location is received by a location receiver circuit 602. The audio receiver circuit and/or the location receiver circuit may be shared with the portion of the circuit shown in FIG. 4 or they may be an additional audio receiver circuit and/or location receiver circuit that receive additional copies of the sound program and/or location. The audio receiver circuit 600 and the location receiver circuit 602 may be parts of a general receiver circuit. The location receiver circuit 602 may determine desired sound locations in addition to or as an alternative to receiving sound locations provided with the sound program, as was described for the location receiver circuit of FIG. 4.

The sound program is processed by two near-field binaural filters 610, 614 to produce a near-field boundary signal for each ear piece (operation 502.) Each of the two near-field binaural filters 610, 614 is set to filter the sound program and thereby produce near-field boundary signals for enabling a sound to be placed at a location on the near-field boundary 118. This may be achieved by providing location input signals 612, 616 that are adjusted to the near-field boundary that is nearest to the desired location 602 of the sound program, rather than at the desired location 602 of the sound program. The location input signals 612, 616 serve to configure their respective near field binaural filters 610, 614.

First and second in-head signals 606, 618 are received (operation 504.) The first and second in-head signals 606, 618 may be produced by the portion of the circuit shown in FIG. 4 as configured with its location receiver circuit 402 set to the location of the ear piece nearest the desired location of the sound program, rather than at the desired location of the sound program. This is represented in FIG. 6 by locations 608, 620 being labeled "Near Ear."

A blending calculating circuit (blending calculator 604) calculates a blending factor (operation 506.) The blending factor is proportional to a distance between i) the desired location of the sound program and the ear piece nearest the desired location of the sound program. For example, the blending factor may be calculated as $$\frac{|location_{sound} - location_{ear\ piece}|}{|location_{near\ field\ boundary} - location_{ear\ piece}|}$$

It will be appreciated that a blending factor calculated according to the above equation has a value of 1 when the desired location of the sound program, $location_{sound}$, is at the near-field boundary, $location_{near\text{-}field\ boundary}$. The exemplary blending factor has a value of 0 when the desired location of the sound program, $location_{sound}$, is at the ear piece nearest the desired location of the sound program, $location_{earpiece}$. Other values and ranges may be used for the blending factor.

The near-field boundary signals and the in-head signals are panned based on the blending factor (operation 508.) The panned near-field boundary and in-head signals are then combined to produce first and second in-head signals (operation 510.) The first in-head signal 606 may be panned by a first fader 622. The first near-field boundary signal, which may be produced by the first near-field binaural filter 610, may be panned by a second fader 624. The first in-head signal 606 is the signal that would be provided to the first ear piece 104 for a sound located at the boundary 114. The first near-field boundary signal is the signal that would be provided to the first ear piece 104 for a sound located at the near-field boundary 118 closest to the first ear piece 104. The first and second faders 622, 624 are complementary and operate to create an audible impression of the sound moving between the first ear piece and the adjacent near-field boundary without attenuation. For example, at a given location, i) the near-field boundary signal is attenuated by a first amount that is proportional to one minus the blending factor (computed for that location) and the first in-head signal is attenuated by a second amount that is proportional to the blending factor.

The second in-head signal 618 may be panned by a third fader 628. The second near-field boundary signal, which may be produced by the second near-field binaural filter 614, may be panned by a fourth fader 626. The second in-head signal 618 is the signal that would be provided to the second ear piece 106 for a sound located at the boundary 114. The second near-field boundary signal is the signal that would be provided to the second ear piece 106 for a sound located at the near-field boundary 118 closest to the first ear piece 104. The third and fourth faders 628, 626 are complementary and operate to create an audible impression of the sound moving between the first ear piece 104 and the adjacent near-field boundary 118 without attenuation. For example, at a given location, i) the near-field boundary signal is attenuated by a first amount that is proportional to one minus the blending factor (computed for that location) and the second in-head signal is attenuated by a second amount that is proportional to the blending factor.

The panned first in-head signal from the first fader 622 and the panned first near-field boundary signal from the second fader 624 may be combined by a first audio mixer 630 to produce a first headphone signal 634 to be provided to the first ear piece 104. The panned second in-head signal from the third fader 628 and the panned second near-field boundary signal from the fourth fader 626 may be combined by a second audio mixer 632 to produce a second headphone signal 636 to be provided to the second ear piece 106.

In some aspects, a first and a second mixed filter are provided that receive the sound program and the blending factor and produce a first and a second headphone signal that are similar to the signals produced by the circuit shown in FIG. 6. It may be advantageous to perform the operations illustrated by the circuit shown in FIG. 6 with a single mixed filter rather than panning and combining the output of in-head and near-field filters because the filters may have frequency dependent phase shifts that create artifacts when combined. Thus, FIG. 6 should be understood as showing both a circuit implemented to combine signals from multiple filters and a circuit that uses mixed filters to create the effect of combining signals from multiple filters.

For clarity of the description, the above has referred to moving a point sound source relative to the listener. However, aspects of the present disclosure may also be applied to stereophonic sound sources. A stereophonic sound source may be recorded to provide left and right channels. Playing the left audio channel to the left ear and the right audio channel to the right ear produces sound that is perceived as being inside the listener's head and centered between the ears. Aspects of the present disclosure may treat movement of a stereophonic sound source from the center of the listener's head to one of the listener's ears, as a transition from a stereophonic sound source to a monophonic sound source. This aspect of how a stereo source is treated as stereo in the head but transitioning to mono once outside the head is developed further below in connection with FIG. 7.

Figure 7:
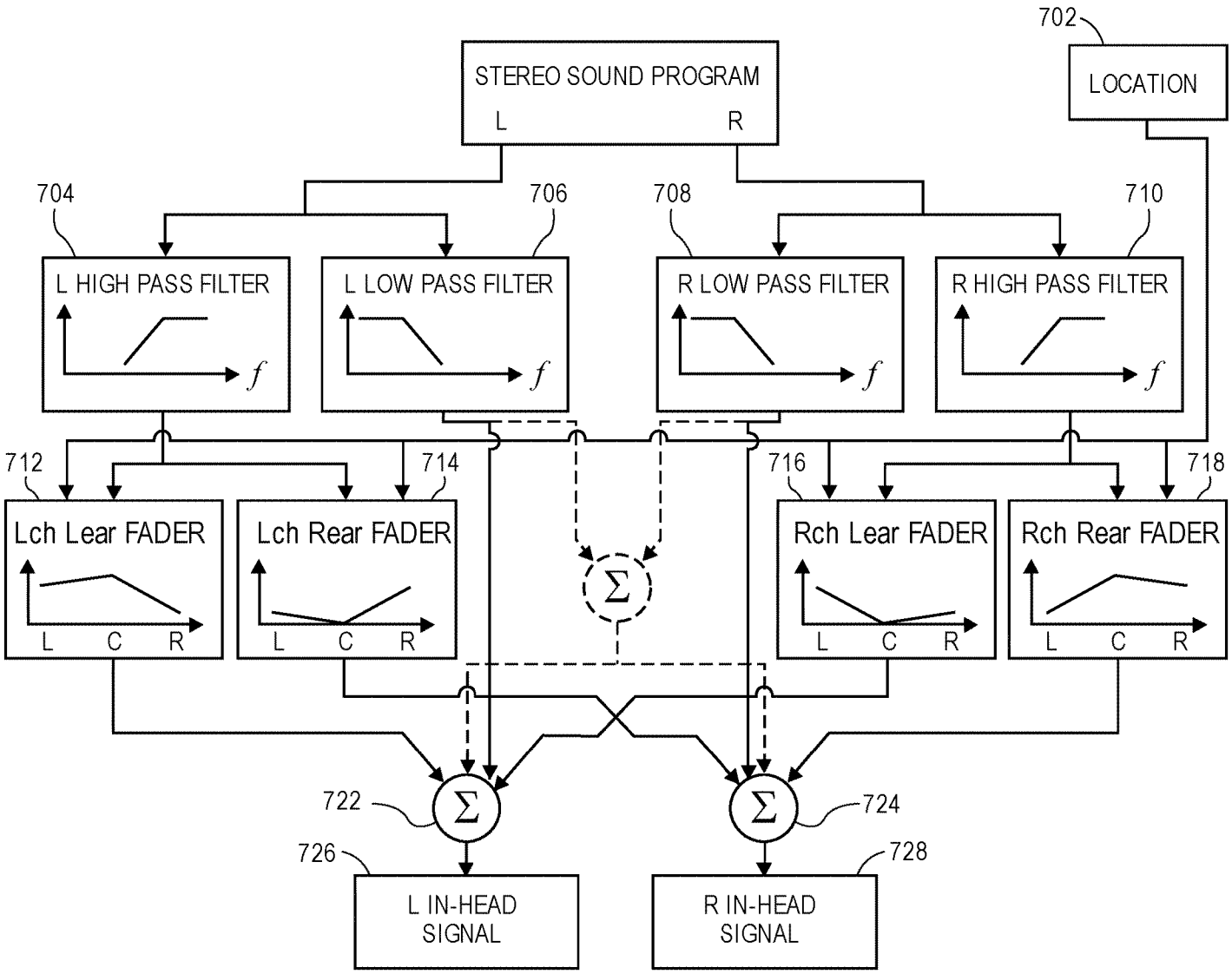
FIG. 7 is a block diagram for a portion of a circuit for processing a stereophonic sound program when the sound location is in the in-head region between the two ear pieces.

FIG. 7 is an aspect of a portion of a circuit for processing a stereophonic sound program when the sound location is in the in-head region between the two ear pieces (operation 202.) The stereo sound program is received by an audio receiver circuit 700. The sound program is filtered to produce a low-frequency portion and a high-frequency portion. One of a set of low pass filters 706, 708 and one of a set of complementary high pass filters 704, 710 may be used to produce the low-frequency and high-frequency portions for each channel of the stereo sound program, as shown. Complementary is used herein to mean that the two filters (low pass and high pass) operate with attenuations of the filtered low- and high-frequencies such that combining the filtered portions will produce a signal that is audibly similar to the unfiltered sound program.

The high-frequency portion of each channel is panned according to the location to produce a first high-frequency panned portion for the ear intended to hear the channel, and a second high-frequency panned portion for the opposite ear. For example, a first fader 712 may pan the left channel as shown, to provide an audio portion of the left channel for the left ear, while a second fader 714 pans the left channel to provide an audio portion of the left channel for the right ear. Likewise, a third fader 718 may pan the right channel to provide an audio portion of the right channel for the right ear, and a fourth fader 716 may pan the right channel to provide an audio portion of the right channel for the left ear, as shown. The mixers 722, 724 are provided to combine the outputs from the faders 712, 714, 716, 718 (as shown) to produce in-head signals 726, 728, respectively, for each of the ear pieces 104, 106 on the headphones 102 worn by the listener 100.

Figure 8:
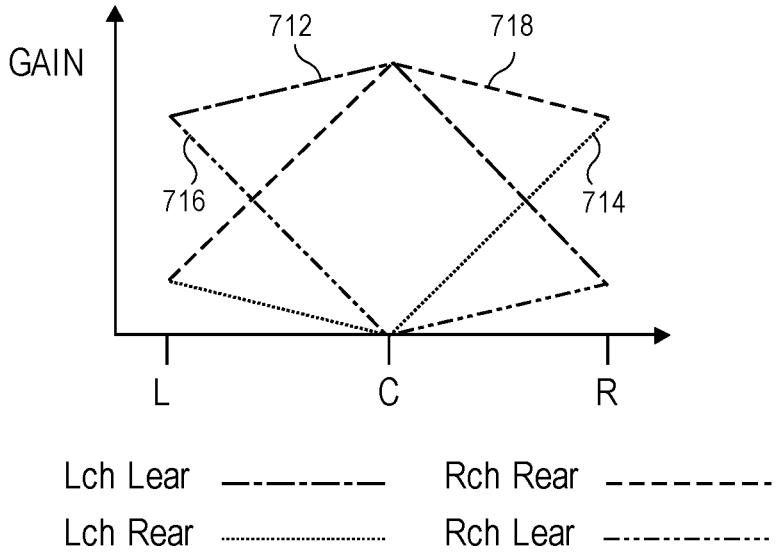
FIG. 8 is a graph of the gains for each of the faders shown in FIG. 7.

FIG. 8 is example graph of how the gains of the faders 712, 714, 716, 718 shown in FIG. 7 vary (as a function of the desired location of the sound program.) When the stereophonic sound program is to be located at the center C of the listener's head (indicated by C along the x-axis of each of the gain graphs shown inside the boxes representing the four faders), the audio portion is provided with maximum gain from the faders 712, 718 (for each channel to the ear intended to hear the channel), and with minimal gain from the faders 714, 716 (for each channel to the ear not intended to hear the channel.) Thus, when the stereophonic sound program is located at the center C of the listener's head, the high-frequency portion of the stereophonic sound program is provided to the listener in stereo.

When the stereophonic sound program is to be located at one of the listener's ears, the audio portion is provided with an equally high gain from the faders 716, 712 for the two channels fed to the ear at which the stereo program is to be located (e.g., the left earpiece, L, indicated on the x-axis of the gain graph), and with an equally low gain from the faders 718, 714 for the two channels to the opposite ear. The "high" gain for the channels directed to the ear at which the stereo program is located may be a value that produces a monophonic sound program that is perceived as having substantially the same volume as the stereo program located at the center of the listener's head. The "low" gain for the channels directed to the opposite ear may be chosen to avoid a sensation of occlusion or may be a level at which the high-frequency portion of the stereophonic sound program is imperceptible.

As the location of the stereophonic sound program moves from the center of the listener's head to one of the listener's ears, the faders 712, 714, 716, 718 pan each of the channel signals for each of the listener's ears as suggested by the graphs shown in FIG. 8 to smoothly transition from a stereo program to a mono program.

Returning to FIG. 7, the mixers 722, 724 combine the high frequency and low-frequency portions of the sound program (mixer 722 receives all portions of the left channel both low and high portions, while mixer 724 receives all—both low and high-portions of the right channel) with outputs of the faders 712, 716 (left ear faders) and the faders 714, 718 (right ear faders) to produce in-head signals 726, 728, respectively. Alternatively, the low-frequency portions of the stereo program may be processed as a monophonic program that is delivered equally to both ears when the stereophonic sound program is located between the listener's ears (e.g., at location C.) FIG. 7 shows this aspect in dotted lines, where the outputs of the low pass filters 706, 708 are not directly fed to the mixer 722, but instead are routed through a mixer where they are combined and fed to both of the mixers 722, 724. Under that scenario, it will be appreciated that the left and right (unfiltered) channels of the stereophonic sound program could instead be combined by a mixer and then filtered by a single low pass filter (effectively combining filters 706, 708 into a single filter downstream of the mixer that is shown in dotted lines) to produce the combined low-frequency portions of the stereo program (which is then fed to both of the mixers 722, 724.)

For clarity of the disclosure, the above has described moving a sound source along a path that passes through the center of the listener's head and through the listener's ears, e.g., where the vector shown in FIG. 1 lies along the positive x-axis, or is at an angle of zero degrees relative to the positive x-axis. However, aspects of the present disclosure may also be applied to paths into and out of the listener's head from different angles. If the transition into the head begins from a different angle then the gains of the faders and the location of the near-field boundary 118 will change. For sounds that move on a path perpendicular to the path that passes through the center of the listener's head and the listener's ears, e.g., at an angle of ninety degrees relative to the vector shown in FIG. 1, the fader gains do not change as the sound moves. For other angles the values of the fader gains are varied based on the compounded angle between the line connecting the two ears and the line connecting the source to the center of the head.

For paths that pass through the in-head region 112 or the transition region 116 but not through the center of the listener's head, the path may be processed as transitions between a series of paths through the center of the listener's head at changing angles.

While certain exemplary aspects have been described and shown in the accompanying drawings, it is to be understood that such aspects are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. A method for rendering a sound program for headphones, the method comprising:

receiving a location for placing the sound program with respect to a listener wearing the headphones with a first ear piece that is closer to the location than a second ear piece;

determining whether the location is between the first ear piece and a near-field boundary;

in accordance with a determination that the location is between the first ear piece and a near-field boundary, filtering the sound program with first and second near-field binaural filters to produce a first near-field boundary signal and a second near-field boundary signal, filtering the sound program to produce a low-frequency portion and a high-frequency portion, calculating a blending factor based on a distance between the location and the first ear piece, combining i) the first near-field boundary signal attenuated by a first amount that is based on the blending factor and ii) the low frequency portion attenuated by a second amount that is based on the blending factor, to produce a first headphone driver signal to drive the first ear piece, wherein in response to the blending factor increasing, the first amount decreases while the second amount increases, and combining i) the second near-field boundary signal attenuated by the first amount and ii) the low-frequency portion attenuated by the second amount, to produce a second headphone driver signal to drive the second ear piece.

2. The method of claim 1, wherein the blending factor has a lowest value when the location is at the first ear piece and a highest value when the location is at the near-field boundary.

3. The method of claim 2 wherein the blending factor has a value of zero when the location is at the first ear piece and a value one when the location is at the near-field boundary.

4. The method of claim 2 wherein the first amount is proportional to one minus the blending factor and the second amount is proportional to the blending factor.

5. The method of claim 1, wherein the sound program is a stereo program that includes a first channel and a second channel, the method further comprises combining low frequency portions of the first channel and the second channel to make a monophonic program, and filtering the sound program to produce the low-frequency portion comprises filtering the monophonic program.

6. A method for rendering a sound program for headphones, at a sound location that is in a transition region, the method comprising:

receiving a location for placing the sound program with respect to a listener wearing the headphones having a first ear piece that is closer to the location than a second ear piece;

determining whether the location is between the first ear piece and a near-field boundary;

in accordance with a determination that the location is between the first ear piece and a near-field boundary, filtering the sound program with first and second near-field binaural filters to produce a first near-field boundary signal and a second near-field boundary signal, filtering the sound program to produce a first in-head signal and a second in-head signal wherein the first in-head signal comprises i) a low frequency portion of the sound program that is unchanged by the location and ii) a high frequency portion of the sound program that is panned between the first and second ear pieces according to the location, combining i) the first near-field boundary signal attenuated based on a distance between the location and the first ear piece and ii) the first in-head signal attenuated based on the distance between the location and the first ear piece, to produce a first headphone driver signal to drive the first ear piece, wherein in response to the distance between the location and the first earpiece increasing, attenuation of the first near-field boundary signal decreases while attenuation of the first in-head signal increases, and combining i) the second near-field boundary signal attenuated based on the distance between the location and the first earpiece and ii) the second in-head signal attenuated based on the distance between the location and the first earpiece, to produce a second headphone driver signal to drive the second ear piece.

7. The method of claim 6, wherein combining the first near-field boundary signal and the first in-head signal comprises blending i) a first filter that attenuates the first near-field boundary signal by a first amount that is based on the distance between the location and the first ear piece and ii) a second filter that attenuates the first in-head signal by a second amount that is based on the distance between the location and the first ear piece to form a mixed filter for combining the first near-field boundary signal and the first in-head signal.

8. The method of claim 6, further comprising applying a finite impulse response filter to the combination of the first near-field boundary signal and the first in-head signal to produce the first headphone driver signal, and applying the finite impulse response filter to the combination of the second near-field boundary signal and the second in-head signal to produce the second headphone driver signal.

9. An audio system for rendering a sound program for headphones, at a sound location that is in a transition region, the system comprising:

a processor; and memory having stored therein instructions that configure the processor to determine a location for placing the sound program with respect to a listener wearing the headphones having a first ear piece that is closer to the location than a second ear piece;

in accordance with a determination that the location is between the first ear piece and a near-field boundary, filter the sound program with first and second near-field binaural filters to produce a first near-field boundary signal and a second near-field boundary signal, filter the sound program to produce a first in-head signal and a second in-head signal wherein the first in-head signal comprises i) a low frequency portion of the sound program that is unchanged by the location and ii) a high frequency portion of the sound program that is panned between the first and second ear pieces according to the location, combine i) the first near-field boundary signal attenuated based on a distance between the location and the first ear piece and ii) the first in-head signal attenuated based on the distance between the location and the first ear piece, to produce a first headphone driver signal to drive the first ear piece, wherein in response to the distance between the location and the first earpiece increasing, attenuation of the first near-field boundary signal decreases while attenuation of the first in-head signal increases, and combine i) the second near-field boundary signal attenuated based on the distance between the location and the first earpiece and ii) the second in-head signal attenuated based on the distance between the location and the first earpiece, to produce a second headphone driver signal to drive the second ear piece.

10. The system of claim 9, wherein combining the first near-field boundary signal and the first in-head signal comprises blending i) a first filter that attenuates the first near-field boundary signal by a first amount that is based on the distance between the location and the first ear piece and ii) a second filter that attenuates the first in-head signal by a second amount that is based on the distance between the location and the first ear piece to form a mixed filter for combining the first near-field boundary signal and the first in-head signal.

11. The system of claim 9, wherein the memory has stored therein instructions that configure the processor to apply a finite impulse response filter to the combination of the first near-field boundary signal and the first in-head signal to produce the first headphone driver signal, and apply the finite impulse response filter to the combination of the second near-field boundary signal and the second in-head signal to produce the second headphone driver signal.

12. The system of claim 9 wherein the memory has stored therein instructions that configure the processor to calculate a blending factor based on the distance between the location and the first ear piece, wherein the first near-field boundary signal is attenuated based on the blending factor, and the first in-head signal is attenuated based on the blending factor.

13. The system of claim 12, wherein the blending factor has a lowest value when the location is at the first ear piece and a highest value when the location is at the near-field boundary.

14. The system of claim 13 wherein the blending factor has a value of zero when the location is at the first ear piece and a value one when the location is at the near-field boundary.

15. The system of claim 14 wherein the first near-field boundary signal is attenuated by a first amount that is proportional to one minus the blending factor and the first in-head signal is attenuated by a second amount that is proportional to the blending factor.

16. The system of claim 9, wherein the sound program is a stereo program that includes a first channel and a second channel, the processor combines low-frequency portions of the first channel and the second channel to make a monophonic program and filters the sound program to produce the first in-head signal by filtering the monophonic program to produce the first in-head signal.

17. An audio system for rendering a sound program for headphones, the system comprising:

a processor; and memory having stored therein instructions that configure the processor to determine a location for placing the sound program with respect to a listener wearing the headphones with a first ear piece that is closer to the location than a second ear piece, in accordance with a determination that the location is between the first ear piece and a near-field boundary, filter the sound program with first and second near-field binaural filters to produce a first near-field boundary signal and a second near-field boundary signal, filter the sound program to produce a low-frequency portion and a high-frequency portion, calculate a blending factor based on a distance between the location and the first ear piece, combine i) the first near-field boundary signal attenuated by a first amount that is based on the blending factor and ii) the low frequency portion attenuated by a second amount that is based on the blending factor, to produce a first headphone driver signal to drive the first ear piece, wherein in response to the blending factor increasing, the first amount decreases while the second amount increases, and combine i) the second near-field boundary signal attenuated by the first amount and ii) the low-frequency portion attenuated by the second amount, to produce a second headphone driver signal to drive the second ear piece.

18. The system of claim 17, wherein the blending factor has a lowest value when the location is at the first ear piece and a highest value when the location is at the near-field boundary.

19. The system of claim 18 wherein the blending factor has a value of zero when the location is at the first ear piece and a value one when the location is at the near-field boundary.

20. The system of claim 19 wherein the first amount is proportional to one minus the blending factor and the second amount is proportional to the blending factor.

* * * * *